US009076602B2

(12) United States Patent
Watson

(10) Patent No.: US 9,076,602 B2
(45) Date of Patent: Jul. 7, 2015

(54) ELECTRICAL ISOLATOR

(75) Inventor: Brett Watson, Queensland (AU)

(73) Assignees: Kaon Holdings PTY LTD, Queensland (AU); Siemen Ltd., Bayswater (AU)

( * ) Notice: Subject to any disclaimer, the term of this patent is extended or adjusted under 35 U.S.C. 154(b) by 214 days.

(21) Appl. No.: 13/808,642

(22) PCT Filed: Jun. 29, 2011

(86) PCT No.: PCT/AU2011/000803
§ 371 (c)(1),
(2), (4) Date: Feb. 28, 2013

(87) PCT Pub. No.: WO2012/003527
PCT Pub. Date: Jan. 12, 2012

(65) Prior Publication Data

US 2013/0200045 A1 Aug. 8, 2013

(30) Foreign Application Priority Data

Jul. 7, 2010 (AU) ..... 2010903024

(51) Int. Cl.

| | |
|---|---|
| ***H01H 9/00*** | (2006.01) |
| ***H01H 9/30*** | (2006.01) |
| ***H01H 33/24*** | (2006.01) |
| ***H01H 33/64*** | (2006.01) |
| ***H01H 33/666*** | (2006.01) |
| *H01H 33/662* | (2006.01) |

(52) U.S. Cl.
CPC ..... *H01H 9/0066* (2013.01); *H01H 33/662* (2013.01); *H01H 2033/66284* (2013.01); *H01H 9/30* (2013.01); *H01H 33/24* (2013.01); *H01H 33/64* (2013.01); *H01H 33/6661* (2013.01)

(58) Field of Classification Search
CPC ..... H01H 33/66261; H01H 33/66207
USPC ..... 218/118–120, 124–129
See application file for complete search history.

(56) References Cited

U.S. PATENT DOCUMENTS

| | | | |
|---|---|---|---|
| 2,239,554 | A | 4/1941 | Duffing |
| 3,560,682 | A | 2/1971 | Kohler et al. |

(Continued)

FOREIGN PATENT DOCUMENTS

| | | | |
|---|---|---|---|
| CN | 1808805 | A | 7/2006 |
| DE | 705382 | C | 4/1941 |

(Continued)

OTHER PUBLICATIONS

Chaly et al: "Pecularities of Non-Sustained Disruptive Dischages at Interruption of Cable/Line Charging Current"; Tavrida Electric, 4 pages; Sevastopol, Ukraine.

*Primary Examiner* — Truc Nguyen
(74) *Attorney, Agent, or Firm* — Laurence A. Greenberg; Werner H. Stemer; Ralph E. Locher

(57) ABSTRACT

An electrical isolator includes a body defining an aperture therethrough, a first electrical contact disposed at a first end of the aperture, a second electrical contact movably disposed at a second end of the aperture, the second contact configured to be operatively movable through the aperture to electrically connect to, or disconnect from, the first contact and at least two concave electrical field control screens fixed to the body at respective ends of, and about, the aperture such that the screens lie transverse to the aperture and an open-end of each concave screen is directed towards the other.

27 Claims, 16 Drawing Sheets

(56) References Cited

U.S. PATENT DOCUMENTS

| | | | | |
|---|---|---|---|---|
| 3,592,984 | A | 7/1971 | Turgeon | |
| 3,598,939 | A | 8/1971 | Heberlein et al. | |
| 3,624,322 | A | 11/1971 | Albright | |
| 4,131,775 | A | 12/1978 | Meyer et al. | |
| 4,484,044 | A | 11/1984 | Yoshigae | |
| 4,591,680 | A * | 5/1986 | Pinnekamp | 218/19 |
| 5,237,137 | A | 8/1993 | Lorenz et al. | |
| 5,841,087 | A | 11/1998 | Füchsle et al. | |
| 6,897,396 | B2 * | 5/2005 | Ito et al. | 218/120 |
| 7,285,743 | B2 * | 10/2007 | Martin | 218/138 |
| 2005/0082260 | A1 * | 4/2005 | Martin | 218/118 |
| 2006/0152890 | A1 | 7/2006 | Yokokura et al. | |
| 2007/0090095 | A1 * | 4/2007 | Yoshida et al. | 218/118 |
| 2008/0000879 | A1 * | 1/2008 | Steffens et al. | 218/124 |
| 2008/0302764 | A1 * | 12/2008 | Stoving | 218/129 |
| 2008/0314874 | A1 * | 12/2008 | Lawall et al. | 218/136 |
| 2010/0032412 | A1 * | 2/2010 | Trondsen | 218/136 |
| 2010/0314357 | A1 * | 12/2010 | Kobayashi et al. | 218/140 |

FOREIGN PATENT DOCUMENTS

| | | | |
|---|---|---|---|
| EP | 0678956 | A1 | 10/1995 |
| EP | 1675143 | A1 | 6/2006 |
| EP | 1680792 | A1 | 7/2006 |
| JP | 2005339918 | A | 12/2005 |
| KR | 20060103433 | A | 9/2006 |
| RU | 2173498 | C2 | 9/2001 |
| RU | 2230383 | C2 | 6/2004 |
| WO | 9107768 | A1 | 5/1991 |

* cited by examiner

Plot of Electrical Field

Graph of Electrical Stress B-B

Applied Voltage = 135kV
Insulation Medium = Air Only

Plot of Electrical Field

Graph of Electrical Stress B-B

Plot of Electrical Field

Graph of Electrical Stress A-A

Plot of Electrical Field

Graph of Electrical Stress C-C

Plot of Electrical Field

Graph of Electrical Stress A-A

Applied Voltage = 135kV
No external conductive screen

Plot of Electrical Field

Graph of Electrical Stress A-A

Plot of Electrical Field

Graph of Electrical Stress C-C

Applied Voltage = 135kV
External conductive screen
unearthed

Plot of Electrical Field

Graph of Electrical Stress A-A

Plot of Electrical Field

Graph of Electrical Stress A-A

ELECTRICAL ISOLATOR

BACKGROUND OF THE INVENTION

This invention relates to an electrical isolator and an associated electrical switch.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

The use of sulfur hexafluoride (SF6) gas in the electrical industry as a gaseous dielectric medium for high-voltage circuit breakers, switchgear, and other electrical equipment is known. However, SF6 gas insulated switches are no longer preferred due to the greenhouse gas effect of SF6 (approximately 23,900 times that of CO2). In addition, switches incorporating SF6 gas require sealing and such sealed switches generally attract higher maintenance costs to ensure proper operation through the lifetime of the switch. A further issue is the recent introduction of reporting requirements associated with such switches, requiring that the switching apparatus is checked annually to determine any leakage, which must then be reported. This reporting places a significant burden on the operators of any such switch gear.

There are generally two types of electrical switches used at medium voltage. The first type is fault make and load break switches. A typical application for such switches is overhead line load break switches and load break switches in a Ring Main Unit (RMU). The second type is fault make and fault break switches. A typical application for these switches is Ring Main Unit (RMU) circuit breakers, e.g. indoor and metal enclosed switchgear, or the like.

An electrical isolating switch generally comprises three main components, namely an interrupter, an isolator, and a mechanism for actuating the interrupter and isolator. A vacuum interrupter is one type of interrupter that is widely used in a wide range of electrical switches that is SF6 free. Their design is well known in the art; however they are unsuitable for use as an isolator due to the very high internal electrical field strength that exists between the open contacts and the fact that, as a result of the shape of the internal electric field, the highest electrical stress occurs at the conducting contact surface. Small asperities and surface imperfections caused by its operation will give rise to so-called "stress raisers" that will result in degradation of such a vacuum interrupter's isolation capacity, typically resulting in a flashover at a lower voltage than designed.

Non Sustained Disruptive Discharges (NSDD) are also a problem with such vacuum interrupters. This phenomenon of NSDD is generally caused in part by impurities in the vacuum switch contact material. Refer to "Peculiarities of non-sustained disruptive discharges at interruption of cable/line charging current" A. M. Chaly, L. V. Denisov, V. N. Poluyanov, I. N. Poluyanova, Tavrida Electric, 22, Vakulenchuka Str., Sevastopol, 99053 Ukraine. For these reasons, it is generally necessary to use an isolator in series with a vacuum interrupter to provide a safe means of isolation.

Some electrical switches are required to make onto a faulted line and then to break the short circuit fault current, whilst other switches are only required to break load currents. This making and breaking of fault currents, or the breaking of load currents, can be carried out by any suitable interrupter such as a vacuum interrupter, solid state electronic interrupter, or air blast interrupter. Other technologies may also be suitable. However, all of these known interrupters require an additional isolator that is able to reliably withstand the maximum voltages that are likely to be seen in service in order to provide safe isolation.

There are a number of prior art documents relating to different types of isolators. For example, U.S. Pat. No. 4,484,044 teaches a load switch which includes a vacuum switch in series with an air disconnecting switch. The vacuum switch comprises a fixed electrode, a movable electrode attached to one end of an axially movable control rod and a retaining spring which exerts a resilient force on the control rod tending to separate the electrodes. The air disconnecting switch comprises a conically shaped male contact and an opposing female contact shaped to permit insertion of the male contact therein. The male contact has a relatively large diameter base portion attached to the other end of the control rod and forming a step with the control rod. The female contact has spring loaded locking projections for releasably engaging the step of the male contact and a stopper for exerting a force on the control rod sufficient to close the electrodes of the vacuum switch when the male contact is moved against the stopper after engagement with the female contact. The spring loading of the locking projections of the female contact, the shape of the male contact and the spring constant of the retaining spring are selected such that the force on the control rod during engagement of the male and female contacts is not sufficient to close the electrodes of the vacuum switch, while the force on the control rod during disengagement of those contacts acts to fully separate the electrodes of the vacuum switch prior to the release of the male contact.

This is a typical design of a prior art isolator, as shown in FIG. 1 (FIG. 3 of U.S. Pat. No. 4,484,044). It consists of moving contact 12, fixed contact 7, and isolating distance L. This type of isolator is used in medium voltage electrical switchgear, both in air and in SF6. SF6 isolators are substantially smaller than air insulated devices since SF6 gas has 2.5 times the dielectric strength of air, therefore an SF6 insulated device is normally 40% of the size of and air insulated device in each linear dimension, resulting in a device which may be only 10 to 20% of the volume of an air insulated device. However, these isolators have the disadvantage of requiring large isolating distances in air as can be seen from the attached electrical field plots of FIG. 2. FIG. 2 shows the electrical field plot of the isolator of FIG. 1. It can be seen that for an isolating distance L of 172 mm the estimated maximum electrical stress will be 2,800 volts/mm. Thus, as air has a breakdown of 3,000 volts/mm, this means that 172 mm is the minimum separation that can be provided for this arrangement to function as an isolator.

Similarly, U.S. Pat. No. 3,598,939 relates to an isolating switch having large metallic electrodes presenting substantially smooth surfaces facing one another, with at least one of the electrodes being movable by means of a moving carriage to which it is secured. The electrodes in the open gap position have a relatively high withstand or insulation strength on switching voltage surge, impulse voltage, and with a relatively small gap space. The movement of the carrier to contact both electrodes corresponds to the closed position of the switch while movement of the carriage to break the contact between the electrodes corresponds to the open position. In that latter position, a substantially uniform electrostatic field is produced in the gap between the electrodes.

U.S. Pat. No. 3,624,322 discloses an isolating switch which employs semispherical-type electrode shielding energized parts which are mounted on the top of a pair of tilted insulator columns. The columns are mounted to a support frame by means of rotor bearings, which, when rotated by an appropriate mechanism, cause the tops of the insulator columns to move in a circular path. Linkages are employed and are responsive to column rotation in a first direction to electrically contact the blade and jaw of the switch arrangement, and to withdraw the blade and jaw in response to column rotation in a second direction to break contact. The smooth surfaces of the electrodes employed face one another in this second instance and provide an open gap condition which produces a substantially uniform electrostatic field between facing surfaces.

U.S. Pat. No. 3,592,984 describes an isolating switch having spherical, ellipsoid, toroid or spheroid electrodes and a retractable switchblade. The electrodes in the open gap position have a relatively high withstand on switching voltage surge, impulse voltage and with a relatively small gap space. The extension of the retractable switchblade to contact both electrodes corresponds to the closed position of the switch while retraction of the switchblade into one of the electrodes corresponds to the open position. In that latter position, an open gap is produced between the electrodes and results in a substantially uniform electrostatic field in the gap. This has the advantage that the switch open gap may be made substantially shorter than the distance from the electrodes to ground and yet insure that any flashover will be between the electrodes and ground rather than across the switch open gap.

U.S. Pat. No. 5,237,137 teaches, in an isolating switch for metal-clad, compressed-gas insulated high-voltage switchgear, a mechanical control unit containing a rotatably supported lever arrangement. The lever arrangement locks automatically in a neutral position and retains an auxiliary contact pin until it is released by a guide surface connected to the main contact pin. A mating contact of the auxiliary contact pin is also spring-loaded and follows this auxiliary contact pin somewhat after being released, initially while maintaining the equipotential bonding.

U.S. Pat. No. 4,591,680 provides for an isolating switch, which is suitable for electrically isolating and connecting components of gas-insulated encapsulated switching stations under, at the most, low load conditions, wherein a fixed contact member is provided with a central trailing contact which ends in a contact member. It is coaxially surrounded by a circle of rated-current fingers and a fixed contact shielding electrode. The central contact rod of the movable contact member is coaxially surrounded at a distance by a shielding electrode which is also movable. In order to prevent undesirable flash-overs, in particular flash-overs at the encapsulation, the rated-current fingers are in contact with the contact rod in the area surrounded by the shielding electrode which is also movable. They are mounted to be rotatable and have forces applied to them which press their end members radially inward.

The contact member is constructed as a shield-like plate having a front face which is domed forward towards the movable contact arrangement. When the trailing contact is pushed back, the rated-current fingers, which are located behind the front face when the trailing contact is pushed forward, project through openings in the contact member. The contact rod and the shielding electrode which moves along with the former are provided with circumferential grooves.

The above prior art switches are generally focused on convex electrical field control electrode shapes. There currently exists a requirement for a compact and low cost air insulated unsealed electrical isolator to be used either alone or in combination with an interrupter to create an SF6-free electrical isolating switch.

SUMMARY OF THE PRESENT INVENTION

In a first broad form the present invention seeks to provide an electrical isolator which includes:

a) a body defining an aperture therethrough;

b) a first electrical contact arranged at a first end of the aperture;

c) a second electrical contact movably arranged at a second end of the aperture, said second contact configured to be operatively movable through the aperture to electrically connect to, or disconnect from, the first contact; and d) at least two concave electrical field control screens fixed to the body at respective ends of, and about, the aperture such that the screens lie transverse to the aperture and an open-end of each concave screen is directed towards the other.

Typically the body is manufactured from a solid dielectric insulating material.

Typically the aperture is tubular.

Typically the electrical isolator includes a sliding contact for connecting the first contact to the second contact in the aperture.

Typically the electrical isolator includes a mechanism configured to actuate the second contact through the aperture into, or out of, contact with the first contact.

Typically the body includes an external conductive screen.

Typically the external conductive screen includes a conductive paint or a sprayed metal coating.

Typically the external conductive screen is earthed, in use.

Typically said screens are configured to modify the electrical field in the aperture to thereby maintain a desired electrical stress profile between the contacts.

In a second broad form the present invention seeks to provide an electrical isolator which includes:

a) a body defining an aperture therethrough;

b) a first electrical contact arranged at a first end of the aperture;

c) a second electrical contact movably arranged at a second end of the aperture, said second contact configured to be operatively movable through the aperture to electrically connect to, or disconnect from, the first contact; and d) at least two electrical field control screens extending outwardly from respective ends of the aperture, the screens modifying the electrical field in the aperture to thereby maintain a desired electrical stress profile between the contacts.

Typically the body is manufactured from a solid dielectric insulating material.

Typically the aperture is tubular.

Typically the electrical isolator includes a sliding contact for connecting the first contact to the second contact in the aperture.

Typically the electrical isolator includes mechanism configured to actuate the second contact through the aperture into, or out of, contact with the first contact.

Typically the electrical isolator the body includes an external conductive screen.

Typically the electrical isolator the external conductive screen includes a conductive paint or a sprayed metal coating.

Typically the electrical isolator the external conductive screen is earthed, in use.

Typically said screens are configured to modify the electrical field in the aperture to thereby maintain a desired electrical stress profile between the contacts.

In a third broad form the present invention seeks to provide an electrical switch which includes:

a) a housing;

b) an interrupter inside the housing for interrupting an electrical current;

c) an isolator inside the housing and arranged in electrical communication with the interrupter, the isolator having:

d) a body defining an aperture therethrough;

e) a first electrical contact arranged at a first end of the aperture;

f) a second electrical contact movably arranged at a second end of the aperture, said second contact configured to be operatively movable through the aperture to electrically connect to, or disconnect from, the first contact; and g) at least two concave electrical field control screens fixed to the body at respective ends of, and about, the aperture such that the screens lie transverse to the aperture and an open-end of each concave screen is directed towards the other; and h) a mechanism configured for actuating the interrupter and the isolator.

Typically the interrupter includes a vacuum interrupter.

Typically the mechanism includes an insulating pushrod entering the housing through a passage in a portion of the housing having at least two concave electrical field control screens fixed to the portion at respective ends of, and about, the passage such that the screens lie transverse to the passage and an open-end of each concave screen is directed towards the other, said screens configured to distribute an electrical field in the passage in order to provide an area of low electrical stress.

Typically said screens are configured to modify the electrical field in the aperture to thereby maintain a desired, electrical stress profile between the contacts.

In a third broad form the present invention seeks to provide an electrical isolating chamber for electrically isolating first and second regions, the isolating chamber including:

a) a passage extending between the first and second regions;

b) a member extending through the passage;

c) at least two concave electrical field control screens provided about the passage such that the screens lie transverse to the chamber and an open-end of each concave screen is directed towards the other, said screens being configured to distribute an electrical field in the chamber in order to provide a third region of low electrical stress, the member extending through the third region.

Typically at least one of the first and second regions is provided inside a housing for electrical equipment.

Typically said screens are configured to modify the electrical field in the chamber to thereby maintain a desired electrical stress profile along the member.

Typically the member includes at least one of:

a) a mechanical actuator;

b) optical fibres; and, c) fluid pipes.

BRIEF DESCRIPTION OF THE DRAWINGS

An example of the present invention will now be described with reference to the accompanying drawings, in which:—

DETAILED DESCRIPTION OF THE PREFERRED EMBODIMENTS

Figure 3A:
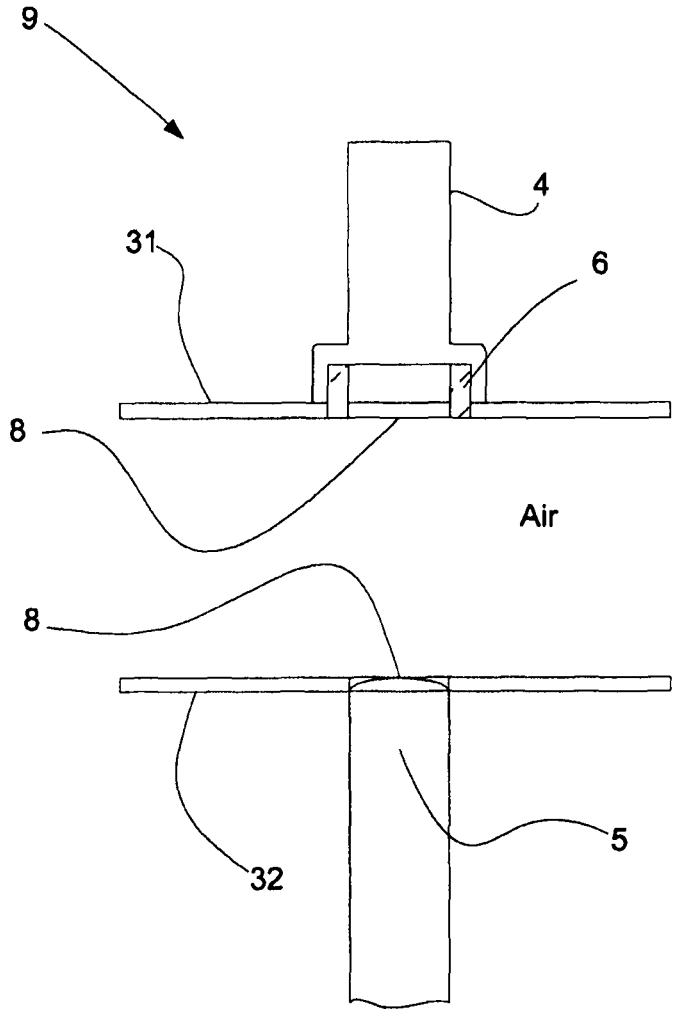
FIG. 3*a* shows an example of an isolator having the two flat parallel plate electrical field control screens.

With reference now to the accompanying drawings, by way of background, FIG. 3*a* shows an example of an electrical isolator 9 with a first electrical contact 4 and a second movable electrical contact 5 which is generally configured to be operatively movable to electrically connect to, or disconnect from, the first contact 4. Sliding contact 6 typically facilitates contact between electrical contacts 4 and 5. The isolator 9 also includes two parallel electrical field control screens 31 and 32 each arranged, as shown, proximate the respective electrical contacts 4 and 5. The screens 31 and 32 lie transverse to the contacts 4 and 5 and the screens 31 and 32 are configured to evenly distribute an electrical field in order to reduce electrical stress between said screens 31 and 32 when the contacts 4 and 5 are disconnected.

Figure 3B:
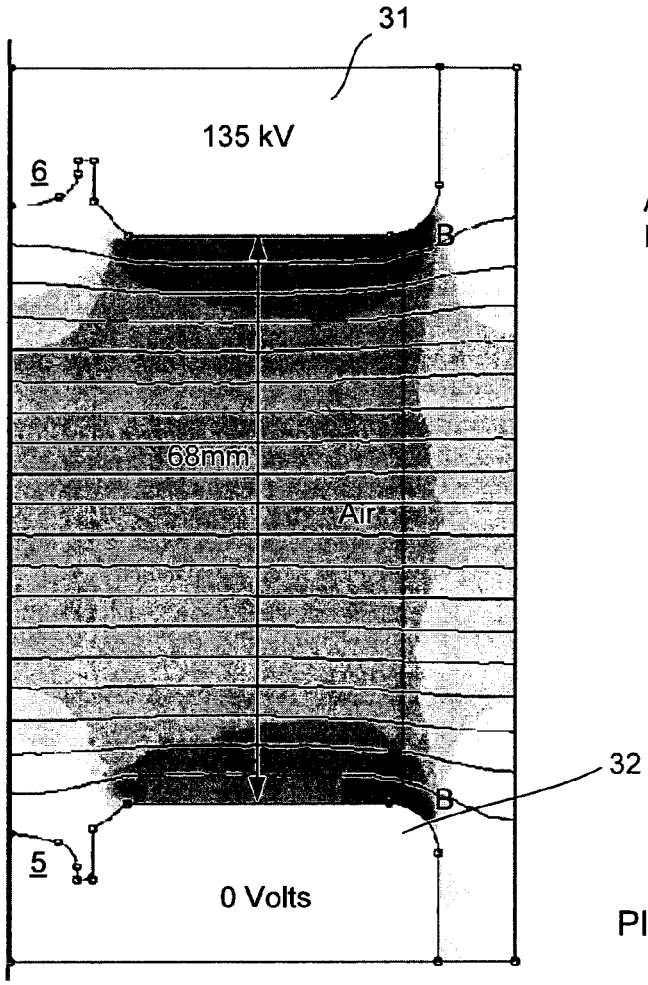
FIGS. 3*b* and 3*c* show general electric field plots in air of the two flat parallel plate electrical field control screens.
Figure 3C:
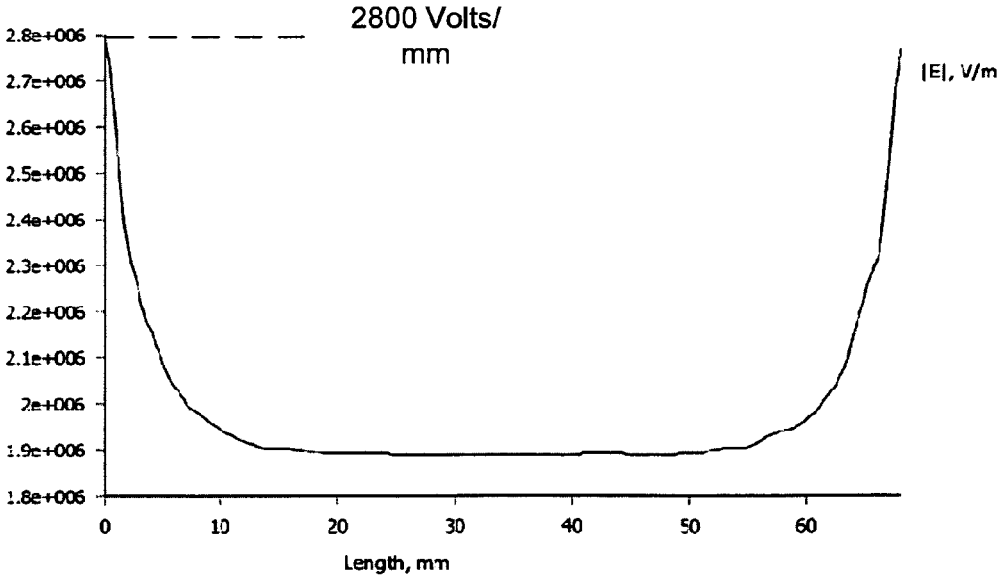

FIGS. 3*b* and 3*c* show the electrical field plot of another example of two parallel plate electrical field control screens 31, 32 in air, displaced from each other by a distance of 68 mm. As shown in the graph of FIG. 3*c*, this conductor arrangement results in an estimated maximum electrical stress of 2,800 V/mm just before the contacts 4 (by means of sliding contact 6) and 5 electrically connect to each other.

Figure 4A:
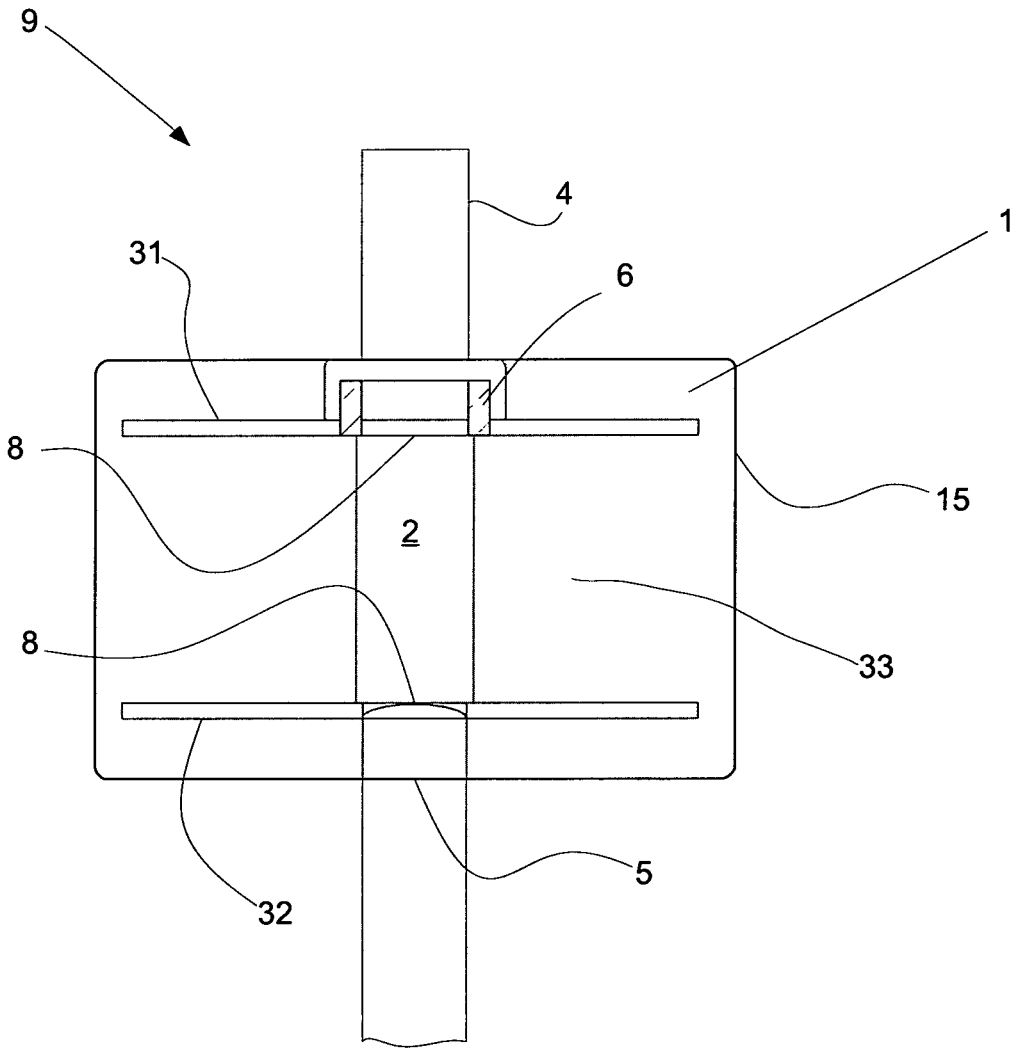
FIG. 4*a* shows an example of an electrical isolator in accordance with the current arrangement.

In accordance with an example of the current arrangement, FIG. 4*a* shows an electrical isolator 9 having a body 1 defining an aperture 2 therethrough, as shown. The isolator 9 also includes a first electrical contact 4 arranged at a first end of the aperture 2, and a second electrical contact 5 movably arranged at a second end of the aperture 2. The second contact 5 is generally configured to be operatively movable through the aperture 2 to electrically connect to, or disconnect from, the first contact 4 by way of sliding contact 6. The isolator 9 also includes at least two electrical field control screens 31 and 32 extending outwardly from respective ends of the aperture 2, as shown. The two opposing parallel plate electrical field control screens 31 and 32 are typically partially embedded in a solid dielectric 33. The screens 31 and 32 are configured to modify the electrical field in the aperture 2 to thereby maintain a desired electrical stress profile between the contacts 4 and 5.

The aperture or central hole 2, preferably round, provides an aperture for the second or moving contact 5 to pass through. The moving contact 5 is typically driven from a suitable mechanism. It may be manually or electrically operated by any one of many suitable operation mechanisms that persons skilled in the art would be familiar with. In one example, the moving contact 5 typically connects with the first or fixed contact 4 by way of a sliding contact 6 so that an electrical circuit is completed. The sliding contact 6 may be a "Multilam" or similar contact.

Figure 4B:
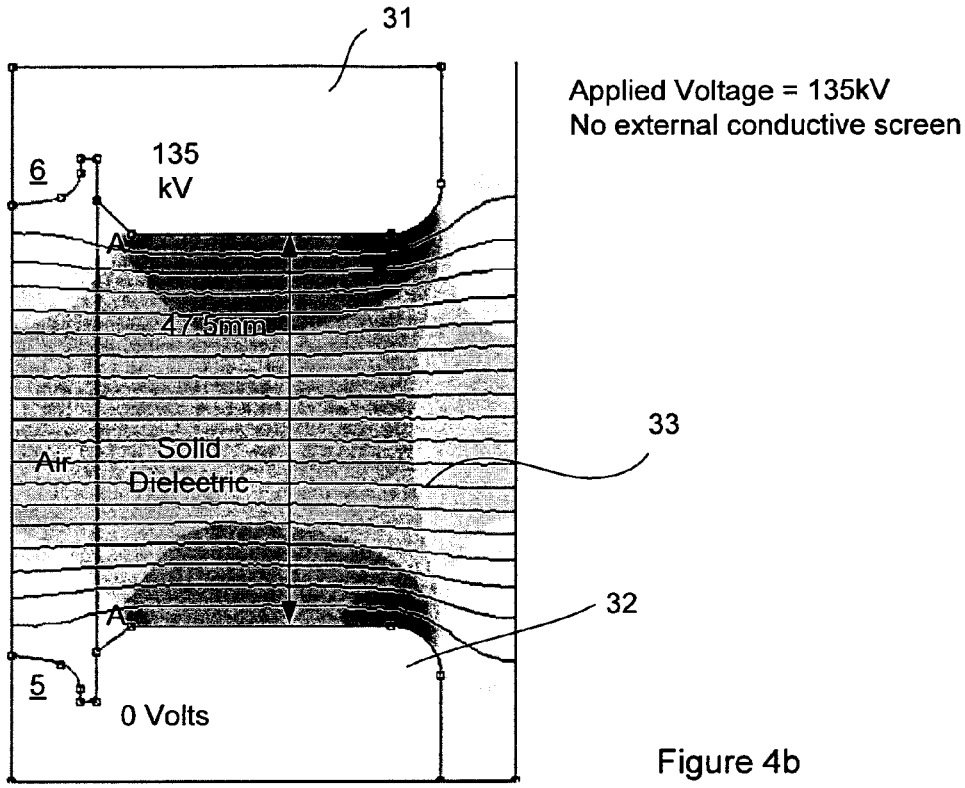
FIGS. 4*b* and 4*c* show typical electric field plots of two flat parallel plate electrical field control screens partially embedded in a solid dielectric, without an external conductive screen.
Figure 4C:
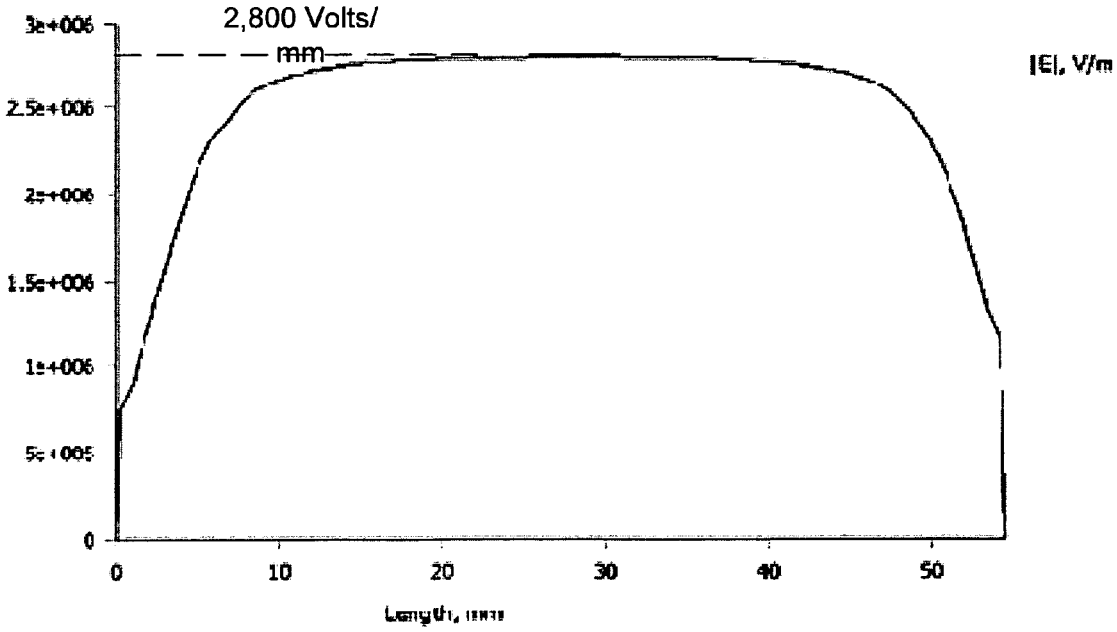

FIGS. 4*b* and 4*c* show an electrical field plot of the two opposing parallel plate electrical field control screens 31, 32 partially embedded in the solid dielectric 33. As shown, an to applied voltage of 135 kv creates an estimated maximum electric stress of 2800 volts/mm at an internal air to solid dielectric interface A-A. Note that the area of high stress associated with air as dielectric between the screens 31 and 32 in FIG. 3*c* is now embedded in the solid dielectric 33 and the separation between the screens can be reduced to 47.5 mm from the initial 68 mm. A comparison of the upside-down shape of the electrical stresses of FIG. 3*c* and FIG. 4*c* show that the electric field gradient is reduced in the arrangement of FIG. 4*a* in the region of the contact 4 (with associated sliding contact 6), s that as the contact 5 approaches the contact 4, the electrical stress will be reduced compared to the arrangement of FIGS. 3*b* and 3*c*.

Figure 5A:
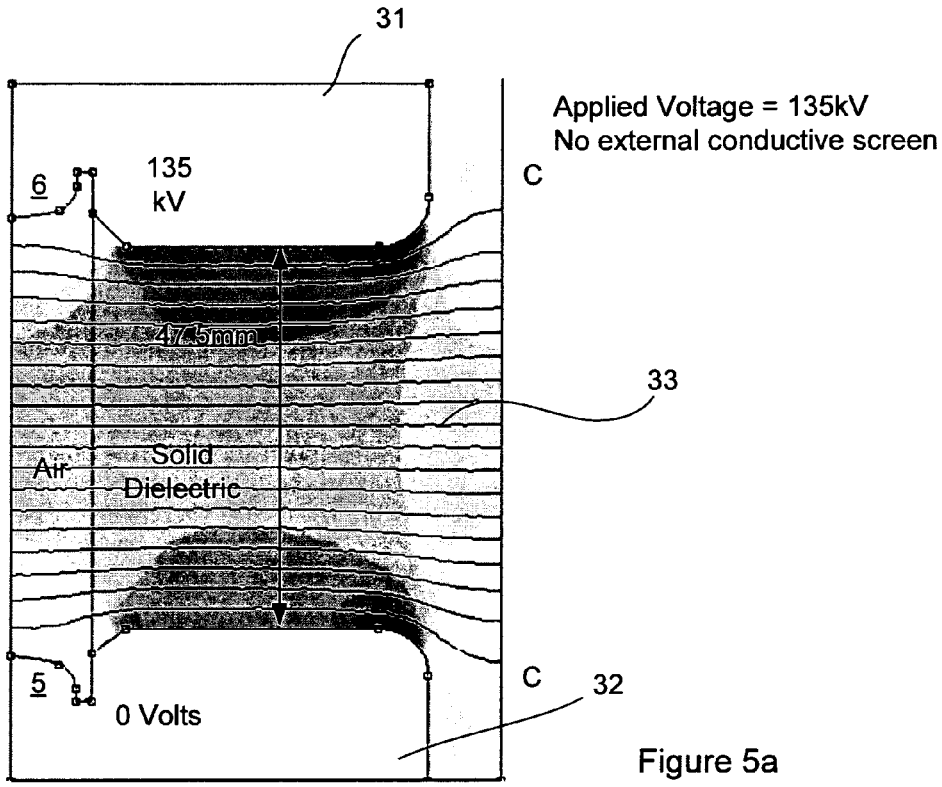
FIGS. 5*a* and 5*b* show further electric field plots of the isolator of FIG. 4 having two flat parallel plate electrical field control screens partially embedded in a solid dielectric, without external conductive screen.
Figure 5B:
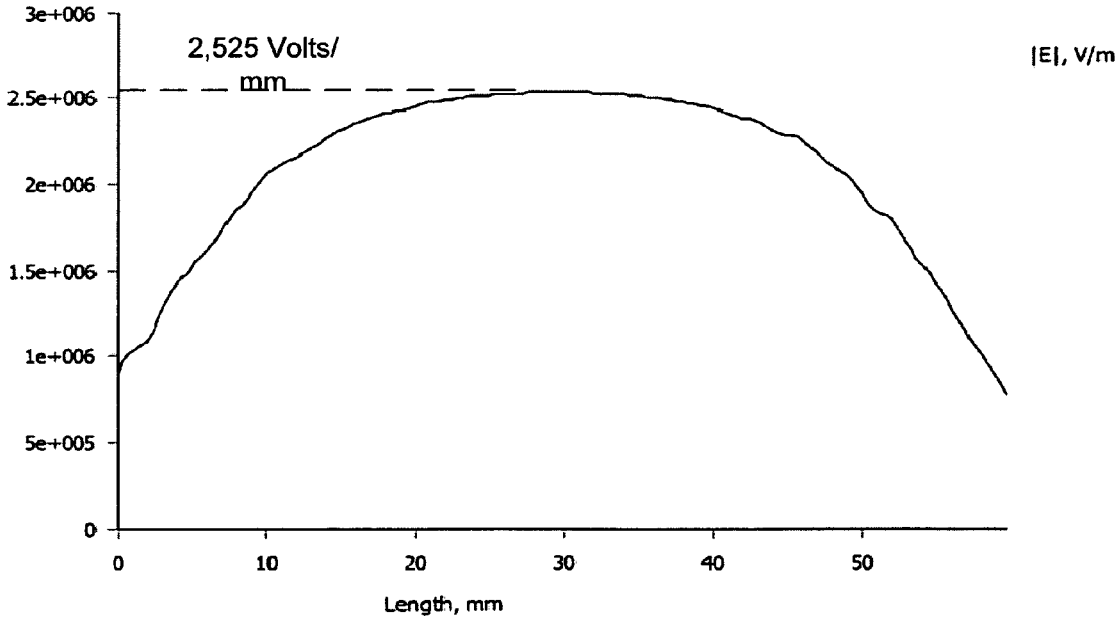

The electrical stresses at air to dielectric interfaces is important in order to predict the reliability over the lifetime of the product., FIGS. 5*a* and 5*b* show a further electrical field plot of the two opposing parallel plate electrical field control screens 31 and 32 partially embedded in the solid dielectric 33. An applied voltage of 135 kv creates an estimated maximum electric stress of 2,525 volts/mm at the external air to solid dielectric 33 interface C-C, which is less than the air break down stress of 3,000 Volts/mm.

Figure 6A:
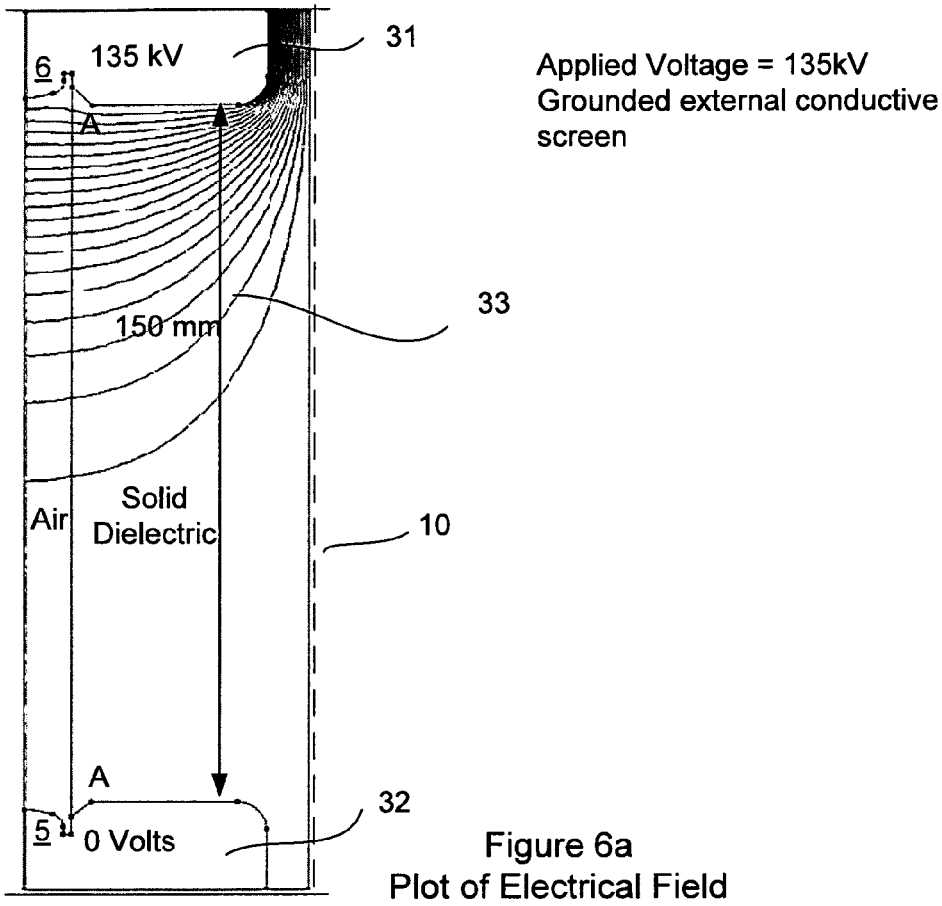
FIGS. 6*a* and 6*b* show typical electric field plots of two flat parallel plate electrical field control screens partially embedded in a solid dielectric with grounded external conductive screen.
Figure 6B:
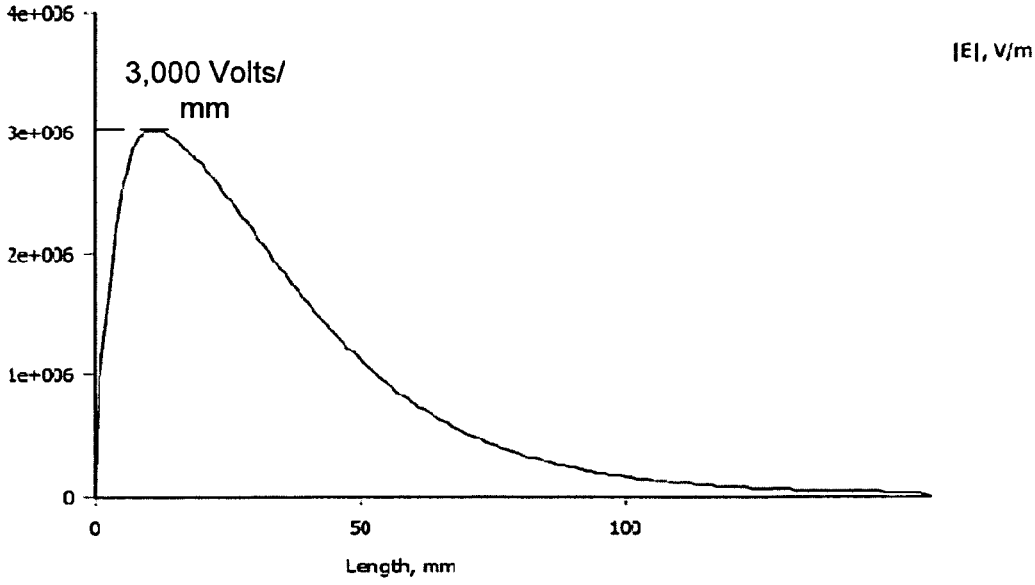

FIGS. 6*a* and 6*b* show an electrical field plot of two opposing parallel plate electrical field control screens 31, 32 partially embedded in a solid dielectric with a grounded external conductive screen 10 added about the dielectric 33, as shown. An applied voltage of 135 kv creates an estimated maximum electric stress of 3,000 volts/mm at the internal air to solid dielectric interface A-A.

As is known in the art of electrical engineering, the most uniform electrical field distribution is achieved by two parallel plates of infinite size. FIG. 3 shows that a reasonably uniform electrical field distribution can indeed be achieved with small parallel control screens separated by an appropriate distance in air. In addition, by partially embedding such screens in a solid dielectric as per FIGS. 4 and 5, the spacing between the contacts 4 and 5 can be reduced. As the reduction in size of an isolator is generally desirable, this aspect is an important feature of the current arrangement.

Without any external influences to the electric field, the electric field in dielectric 33 is typically uniform. However, this arrangement is not suitable for electrical isolator design in practice since the uniform electrical field between the parallel electrical field control screens 31 and 32 is easily disturbed by adjacent electrical fields and grounded structures. When the electrical field becomes disturbed, it generally becomes non-uniform and the maximum stress increases which can cause a significant loss in dielectric performance.

The application of a grounded external conductive screen 10 in FIG. 6 shields the field from such external influences, however it has the effect of causing an increase in the maximum internal electrical stress at A-A. Further increasing the separation does little to reduce the maximum internal electrical stress since it is mostly influenced by the location of the external conductive screen 10. It is therefore seen that whilst uniform electric fields can be achieved by parallel plate electrical field control screens there are several major disadvantages.

Figure 7:
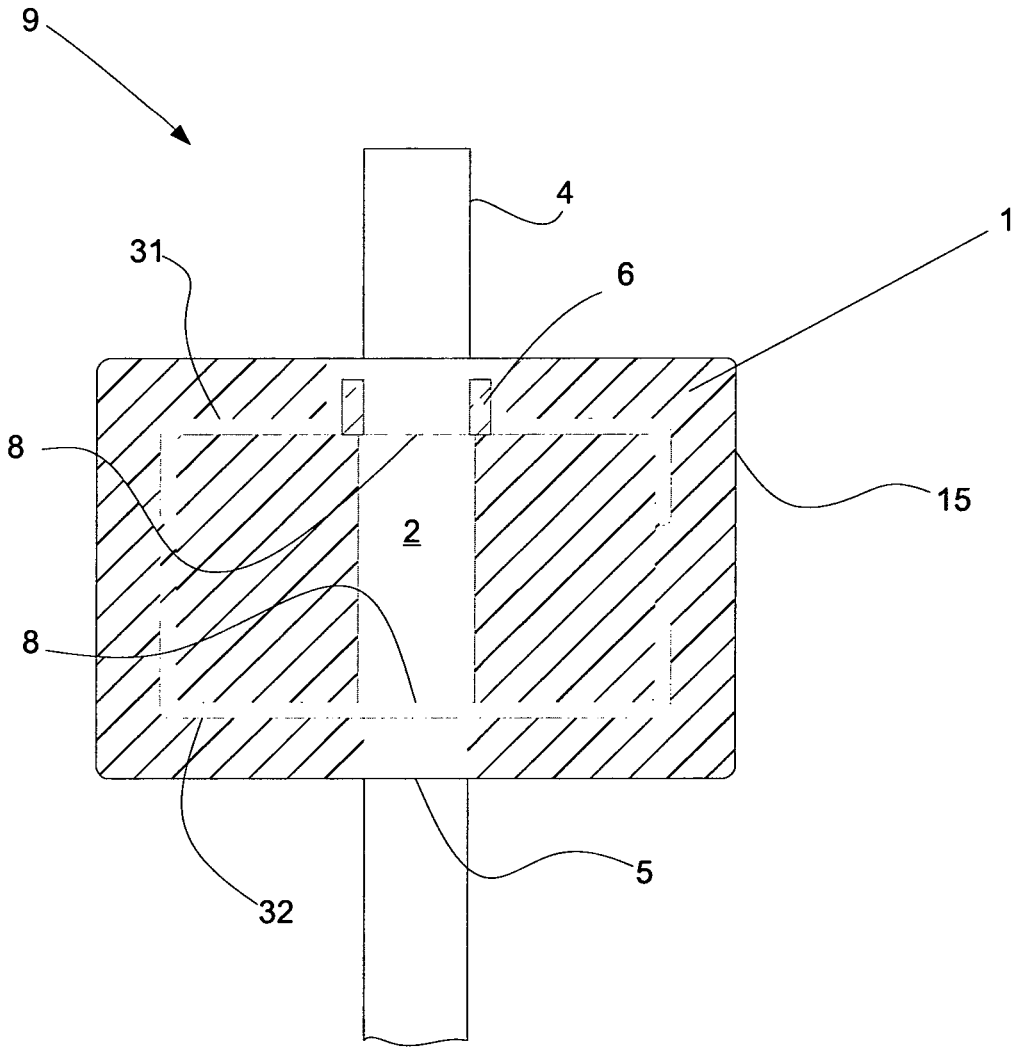
FIG. 7 shows an example of an electrical isolator according to the current arrangement, without an external conductive screen.

FIG. 7 shows an example of an electrical isolator 9, in accordance with the current arrangement. The isolator 9 typically includes a body 1 defining an aperture or hole 2 therethrough. The isolator 9 also includes a first electrical contact 4 arranged at a first end of the aperture 2, as well as a second electrical contact 5 movably arranged at a second end of the aperture 2. The second contact 5 is generally configured to be operatively movable through the aperture 2 to electrically connect to, or disconnect from, the first contact 4 by way of sliding contact 6.

The isolator 9 also includes at least two concave electrical field control screens 31 and 32 fixed to the body at respective ends of, and about, the aperture 2 such that the screens 31 and 32 lie transverse to the aperture 2 and an open-end of each concave screen 31 and 32 is directed towards the other, as shown. The screens 31 and 32 are configured to evenly distribute an electrical field in the aperture 2 in order to reduce electrical stress between said screens 31 and 32 when the contacts 4 and 5 are disconnected. The screens are typically concave and may include a similar bowl-shaped configuration, or the like.

Figure 8:
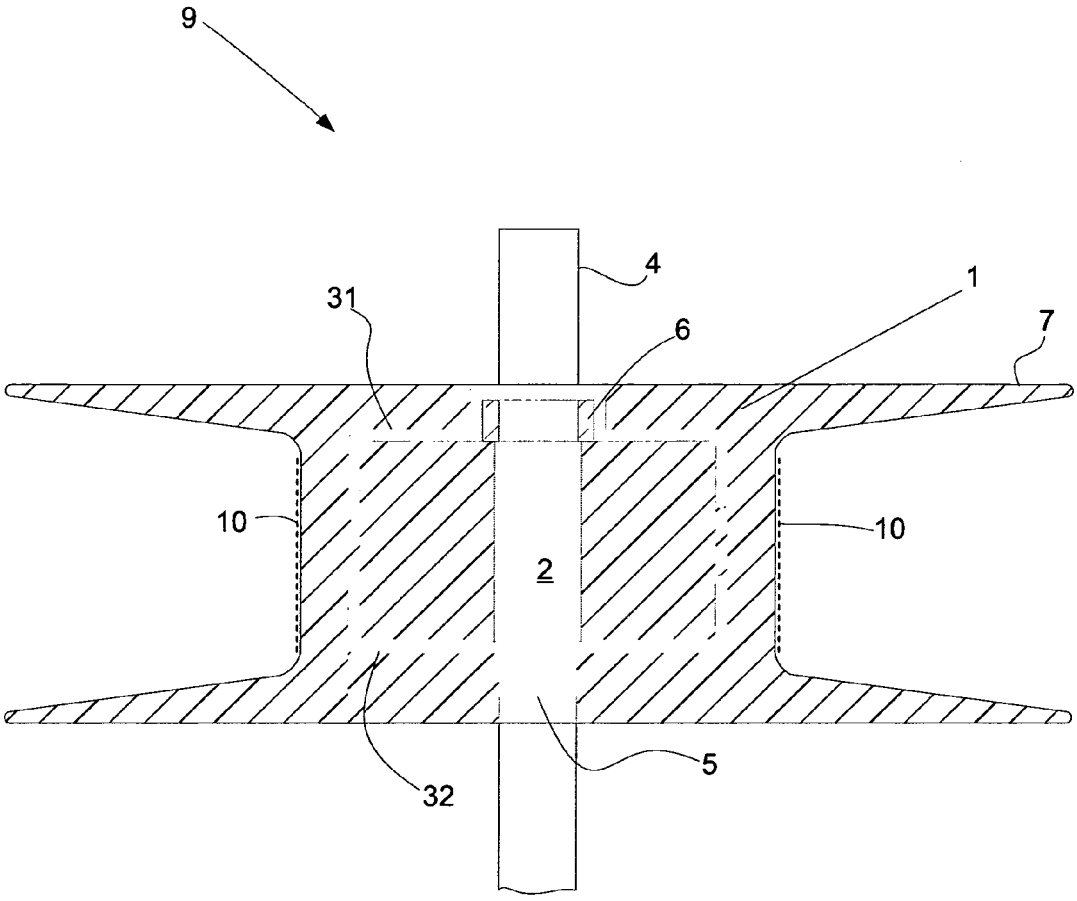
FIG. 8 shows an example of an electrical isolator according to the current arrangement, with external conductive screen.

The example of an isolator 9 of FIG. 8 has an external conductive screen 10 applied where in FIG. 7 it does not. In some circumstances it is preferable to apply an external conductive screen 10 by coating the external surface of the body 1 with a conductive coating as an electrical field control measure. In some circumstances it may be preferable to earth this conductive screen, in use. The external conductive screen 10 is preferably a conductive paint or a sprayed metal coating.

The body 1 of the current arrangement is preferably, but not necessarily tubular or circular, about the centerline and made of a suitable solid dielectric insulating material such as a polymer. The preferred polymer is an electrical grade epoxy resin such as Huntsman CW2229. If it is to be used in an outdoor environment, then a suitable cyclo-aliphatic epoxy resin is preferred such as a Huntsman CY184 or CY5622. The dielectric strength of such a polymer is approximately 20,000 Volts/mm whilst the dielectric strength of air is approximately 3,000 Volts/mm. The preferred dielectric constant of the solid dielectric insulating material is in the range of 1 to 6.

The aperture or central hole 2, preferably round, provides an aperture for the second or moving contact 5 to pass through. The moving contact 5 is typically driven from a suitable mechanism. It may be manually or electrically operated by any one of many suitable operation mechanisms that persons skilled in the art would be familiar with. In one example, the moving contact 5 typically connects with the first or fixed contact 4 by way of a sliding contact 6 so that an electrical circuit is completed. The sliding contact 6 may be a "Multilam" or similar contact.

As described above, the concave electrical field control screens 31 and 32 are arranged in an opposing manner and are typically embedded in the body 1. These electrical field control screens 31 and 32 serve to shape the electrical field in such a manner as to optimally shape the lines of equipotential and distribute them evenly such that the resulting electrical stress is as uniform as possible. This ensures the most compact design possible.

The isolators of FIGS. 7 and 8 are generally designed for application in a 12 kV rated system, rated continuous current of 630 Amps, and Lightning Impulse Withstand Voltage (LIWV) of 110 Kv. In order to provide a reliable isolator, and to allow for statistical spread of test results in production, the isolator 9 is typically designed to withstand a LIWV of 135,000 Volts. However, it is to be appreciated that different examples of the isolator 9 can be applied to any rated voltage or current.

Figure 9A:
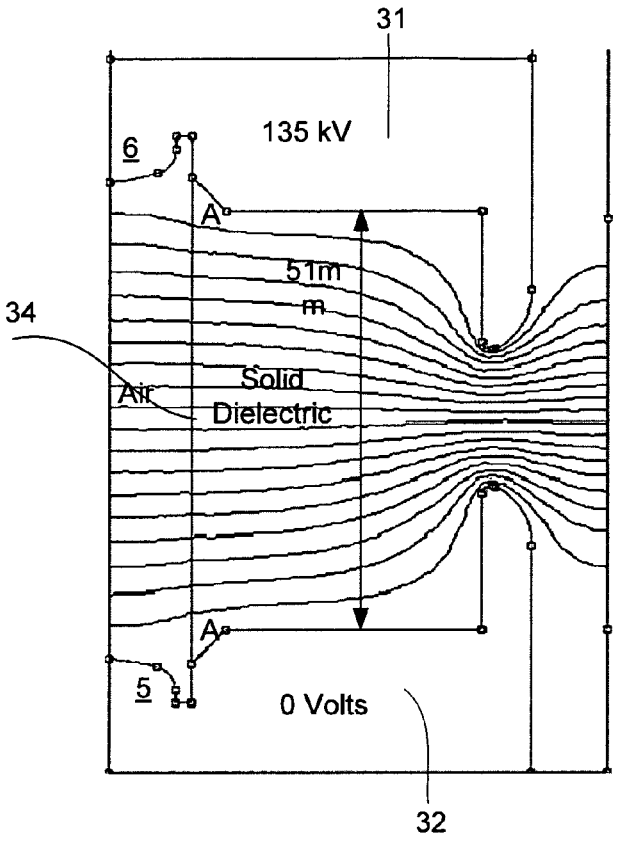
FIGS. 9*a* and 9*b* show an electric field plot of the electrical isolator of FIG. 7.
Figure 9B:
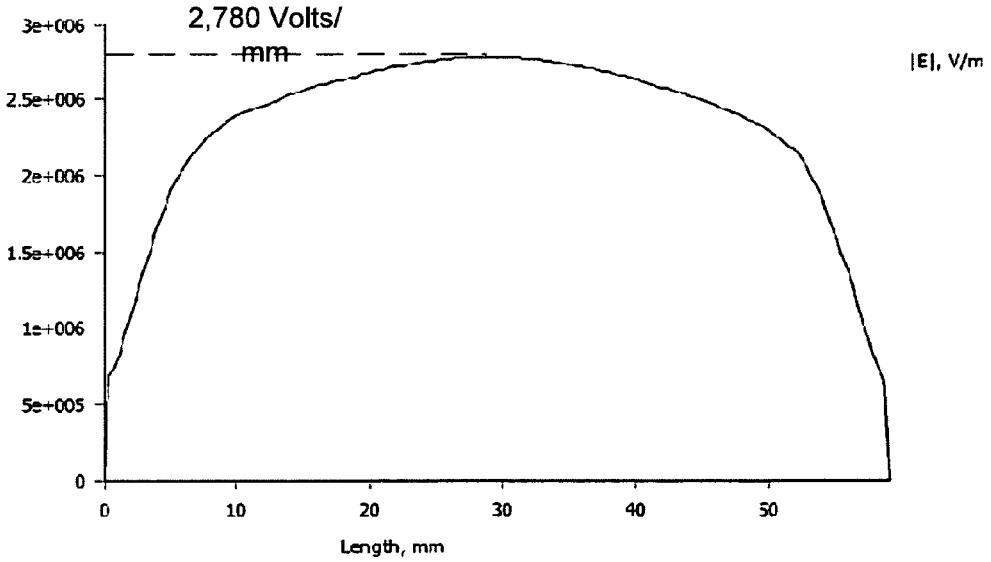

FIG. 9 shows a prediction of the electric stress of the isolator 9 of FIG. 7, without the external conductive screen, at location of highest electrical stress 34 in the solid dielectric to air interface A-A in the central hole 2. The maximum electrical stress is approximately 2,800 Volts/mm midway between the electrical field control screens 31 and 32. This has the desired effect of providing stable isolator performance when the LIWV is applied.

Figure 10A:
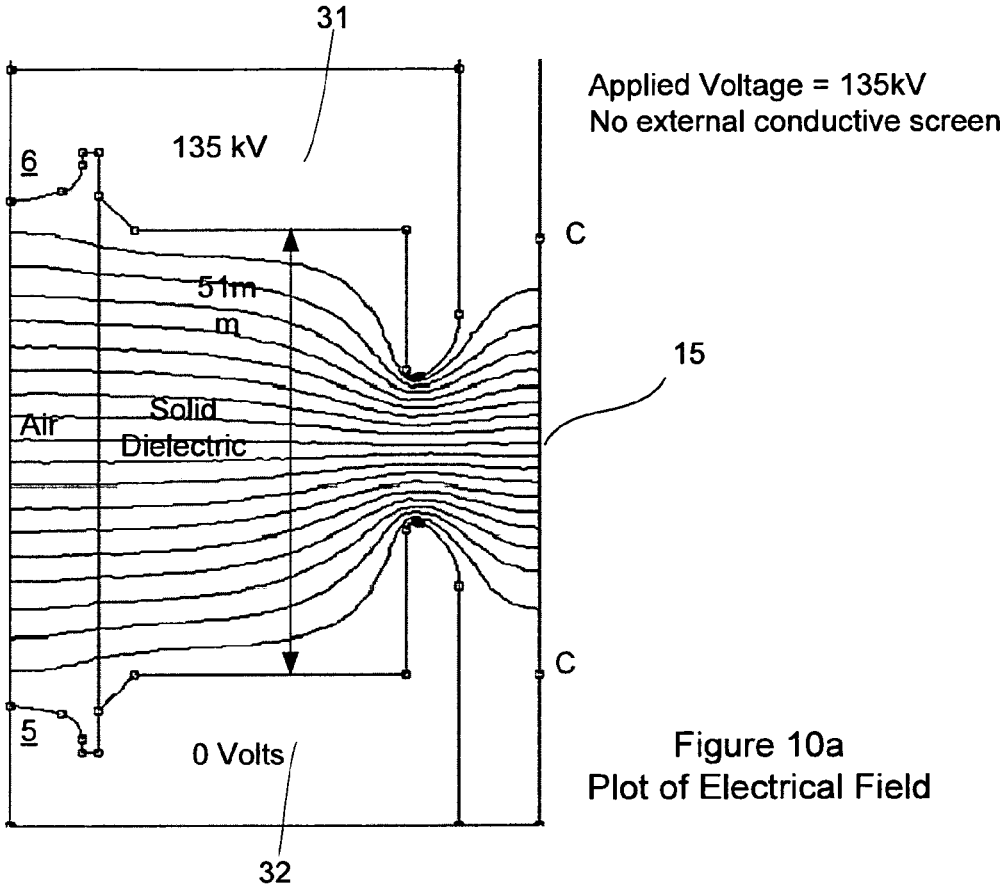
FIGS. 10*a* and 10*b* show a further electric field plot of the electrical isolator of FIG. 7.
Figure 10B:
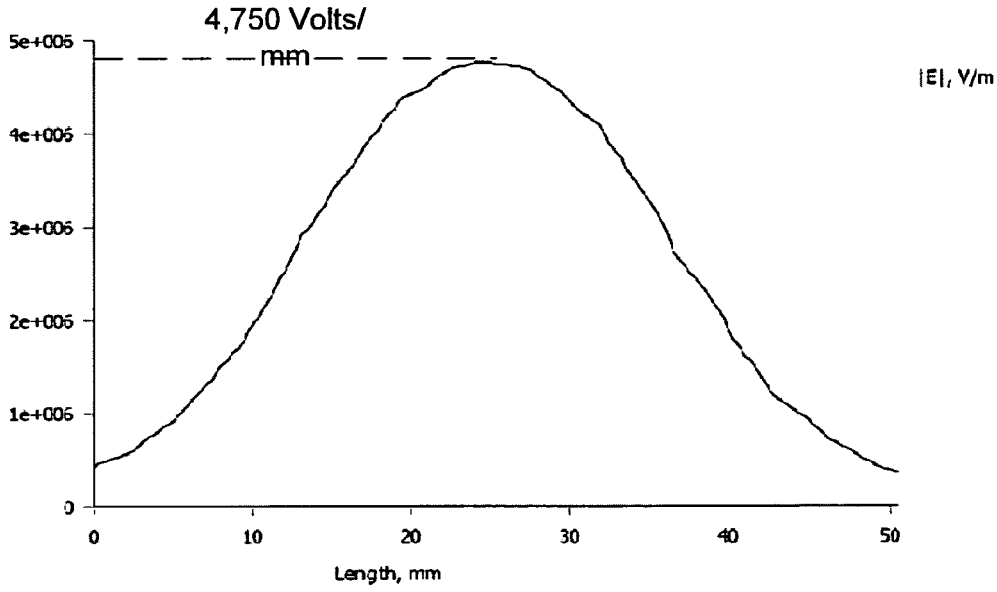

In addition, FIG. 10 predicts the electric stress of the isolator 9, without the external conductive screen 10, at the body 1 to air interface 15 at C-C. Note that the maximum electrical stress is approximately 4,800 Volts/mm. This is undesirable since it will cause the air to become conductive at the instant of the applied LIWV on the surface of the insulator, which will lead possible electrical breakdown externally when the LIWV is applied. Electric stress will also be present at 15 during normal service at the rated voltage and this may give rise to premature failure of the solid dielectric body 1 due to partial discharges created by the electrical stresses in the presence of pollution such as dust, cobwebs or other foreign matter.

Figure 11A:
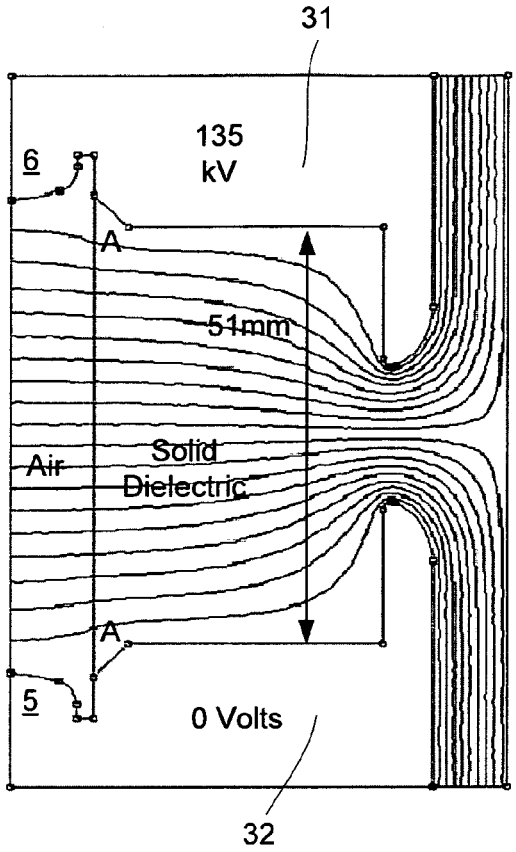
FIGS. 11*a* and 11*b* show an electric field plot of the electrical isolator of FIG. 8.
Figure 11B:
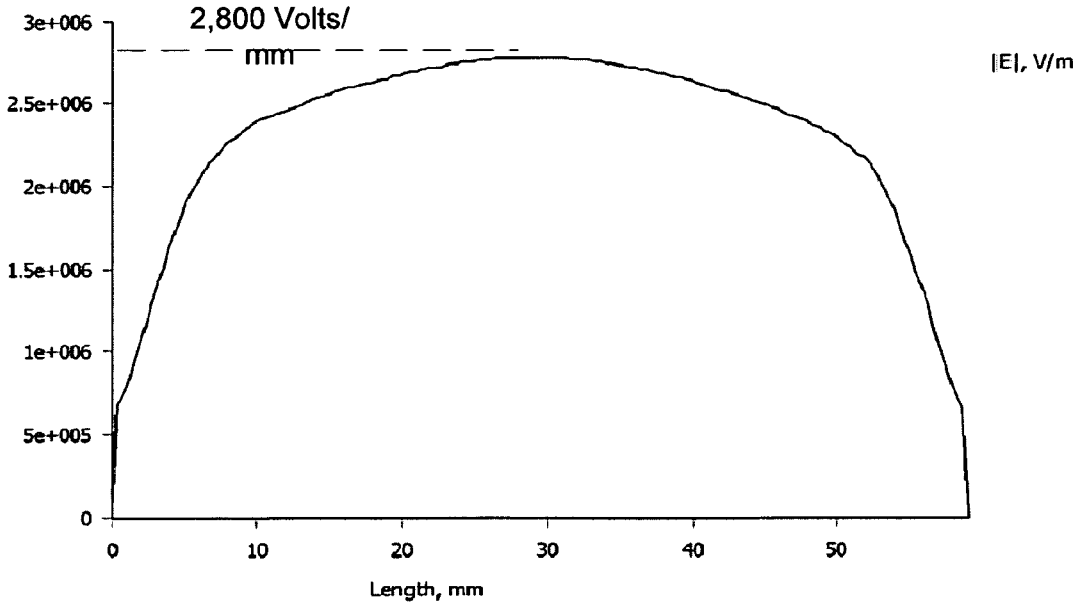

FIG. 11 predicts the electric stress of the isolator 9 of FIG. 8, with the external conductive screen 10 ungrounded (or at a floating potential) at the location of the highest electrical stress in the central hole 2. The maximum electrical stress is approximately 2,800 Volts/mm midway between the electrical field control screens 31 and 32. This also has the desired effect of providing stable isolator performance.

Figure 12A:
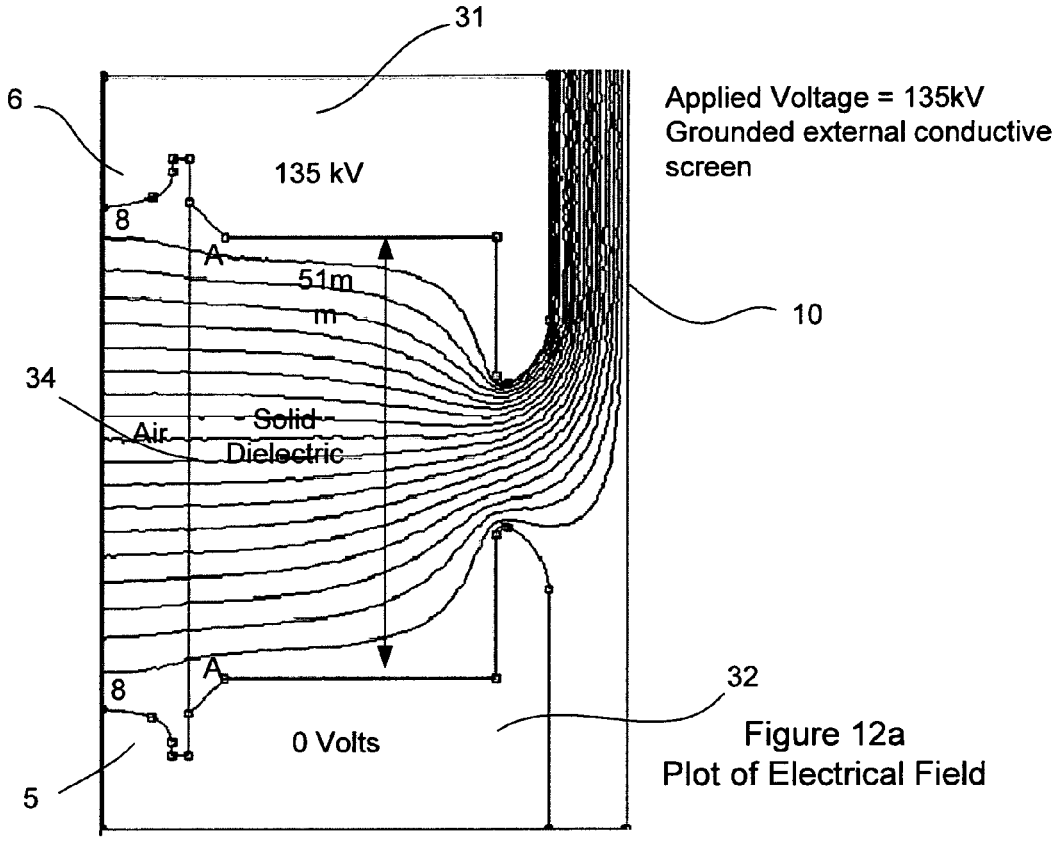
FIGS. 12*a* and 12*b* show an electric field plot of the electrical isolator of FIG. 8 having a grounded external earth screen.
Figure 12B:
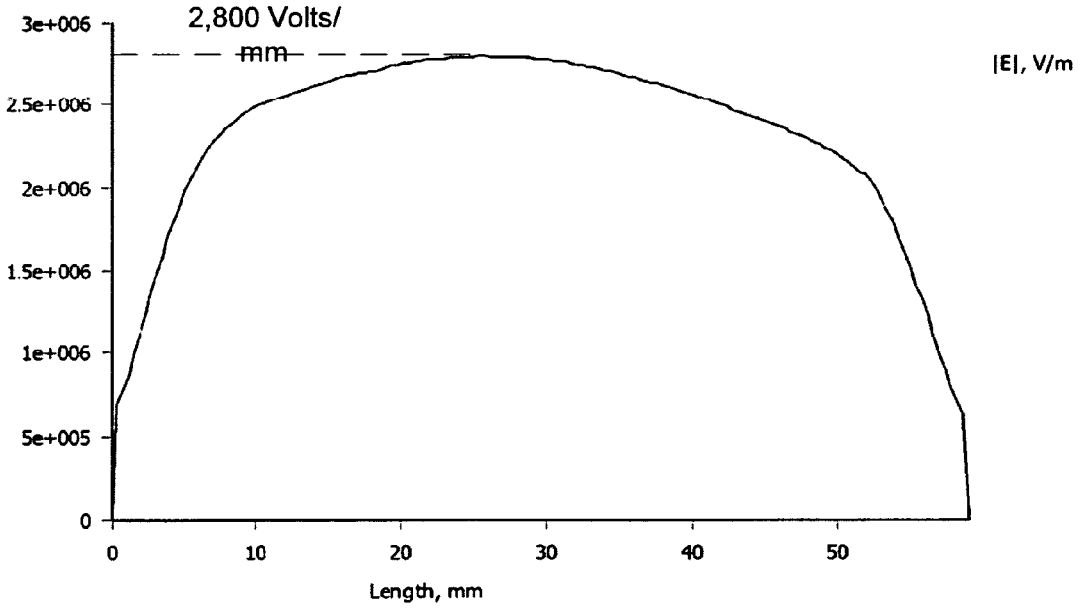

FIG. 12 predicts the electric stress of the isolator 9 of FIG. 8, with the external conductive screen 10 grounded, at the location of the highest electrical stress 34 in the solid dielectric to air interface in the central hole 2. The maximum electrical stress is approximately 2,800 Volts/mm midway between the electrical field control screens 31 and 32.

The isolator 9 generally controls the maximum electrical stress in air by two actions, namely by the opposing concave shape of the electrical field control screens 31 and 32, and due to the fact that the electrical field control screens 31 and 32 are partially encapsulated in a high dielectric strength solid dielectric insulating material in the body 1 in such a manner as to ensure that the areas of maximum electric stress are within the insulating material.

If the maximum electrical stress occurs at the conductor to air interface 8, then any inconsistency in the conductor shape, or asperity, or surface imperfections or irregularities in to the metallic electrode surface will cause, degradation of the isolation capacity. Such irregularities and surface imperfections can be caused by wear during the life of the isolator 9.

By comparing FIGS. 9, 10, 11 and 12 it can be seen that it makes negligible difference to the electrical stress in the air filled central hole 2 whether the external conductive screen 10 is present or not, and whether the external conductive screen 10 is grounded or not.

However the isolator 9 with the external conductive screen 10 grounded is advantageous because the internal field is not influenced by external factors such as other electric fields or other grounded objects; it eliminates any electrical field stress on the surface which may cause long term surface degradation due to the presence of partial discharges that may increase with the presence of dust and other foreign material; it shapes the electrical field such that the maximum electrical stress occurs at the point midway between the electrical field control screens which has the desired effect of providing stable isolator performance; and it provides a grounded surface that is safe to touch.

Figure 1:
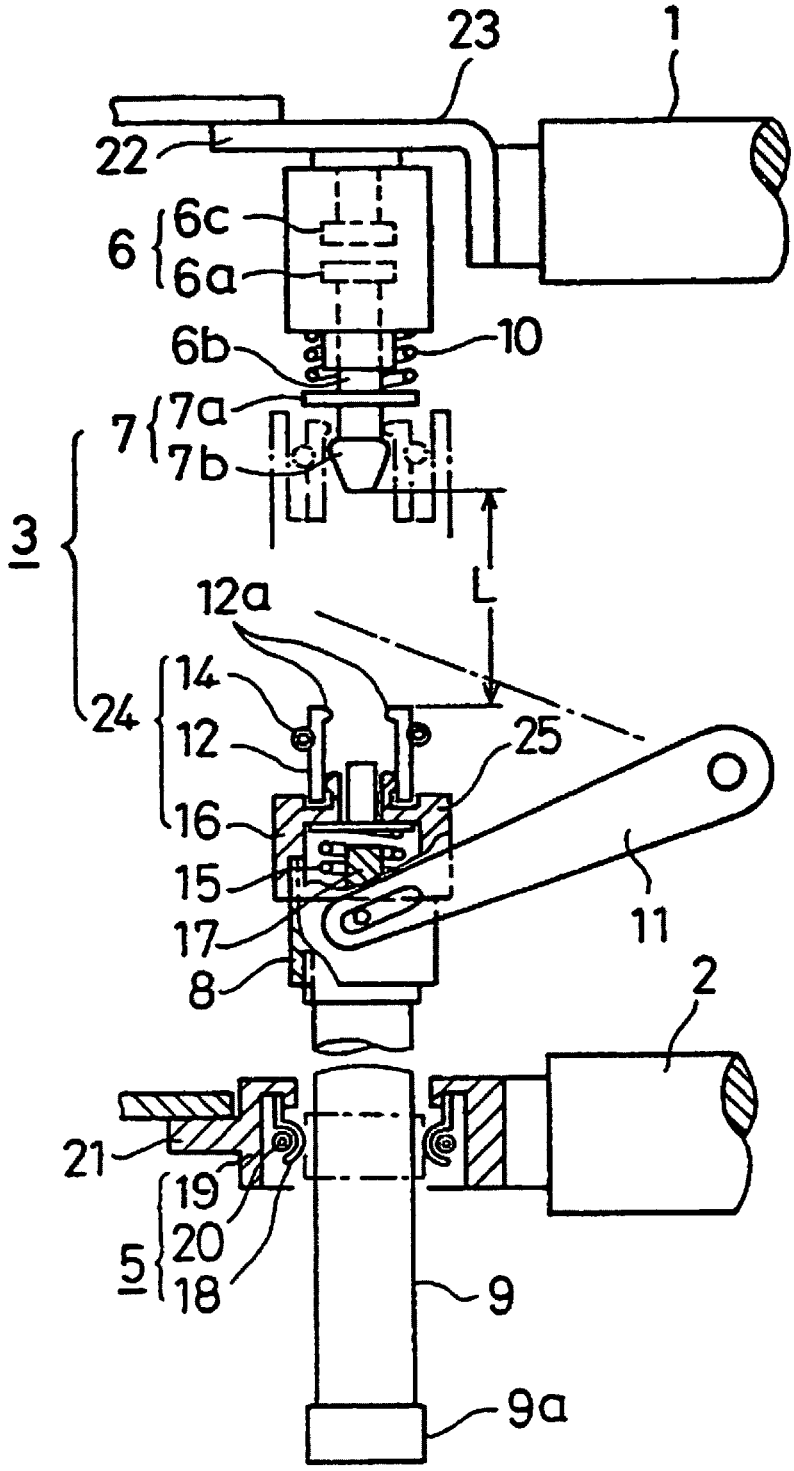
Figure 1 (Prior art).
FIG. 1 shows a type of prior art isolator described in U.S. Pat. No. 4,484,044.
Figure 2A:
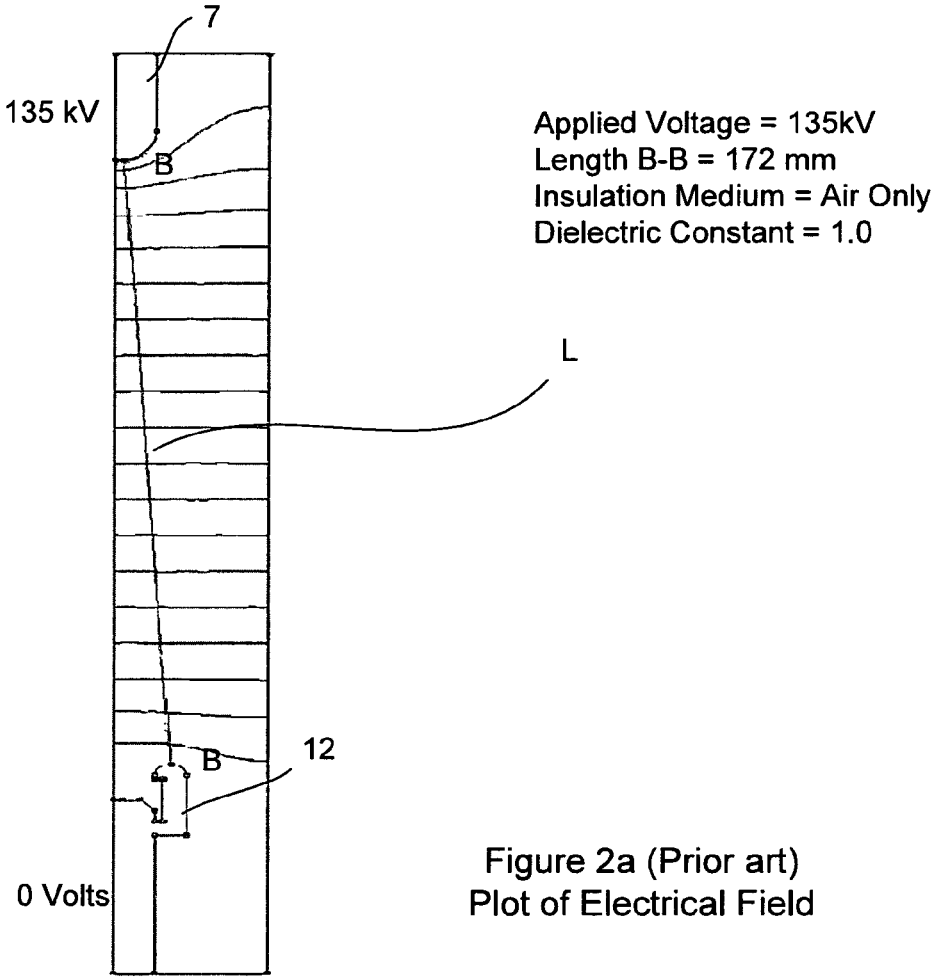
Figure 2a (Prior art)
FIGS. 2*a* and 2*b* show electric field plots in air for the prior art isolator of FIG. 1.
Figure 2B:
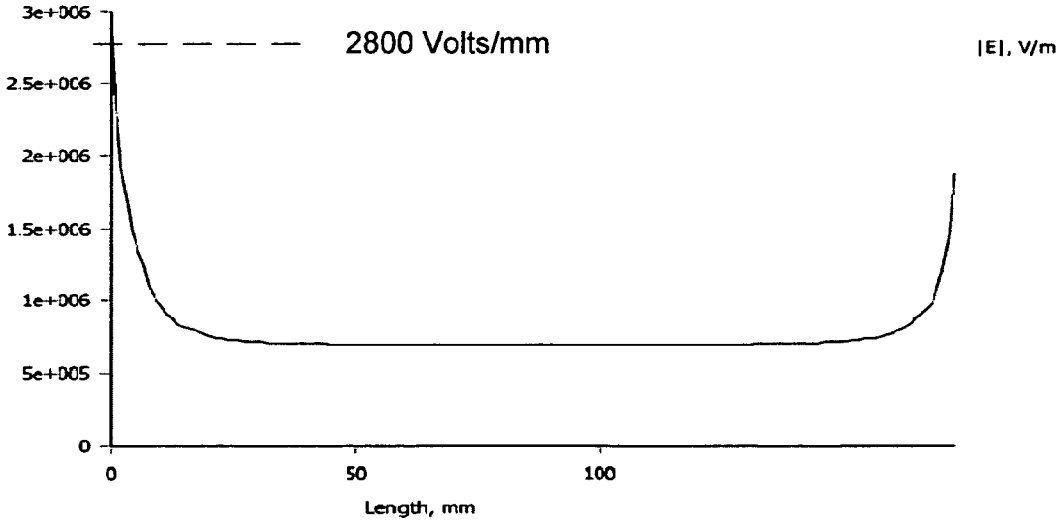
Figure 2b (Prior art)

Due to these improvements, it can be seen that the isolator 9 is generally much smaller and therefore cheaper to manufacture than the prior art isolator shown in FIGS. 1 and 2. It is regarded as advantageous that the isolator 9 has a reduced size compared to the prior art isolators. In general, the isolator 9 has approximately 35% to 40% in the linear dimensions or 10 to 25% of the volumetric dimensions of the prior art isolators having comparable electrical performance. The isolator 9 will therefore be of suitable size and cost to replace prior art isolators that previously have utilized SF6 gas as an insulating medium, however the isolator 9 will not have the environmental consequences of SF6 gas-filled equipment.

It is known that air has a dielectric strength of approximately 3000 Volts/mm. Design work for the isolator 9 assumed 2,800 Volts/mm and testing confirmed this assumption to be reliable for both positive and negative polarities of lightning Impulse withstand voltage. In order to prove an isolator design it is necessary to conduct design tests for each type (type tests) and to prove its isolation capability Lightning Impulse Withstand Voltage (LIWV) tests are required to be satisfied. These tests are specified in the appropriate international standards that apply.

Figure 13:
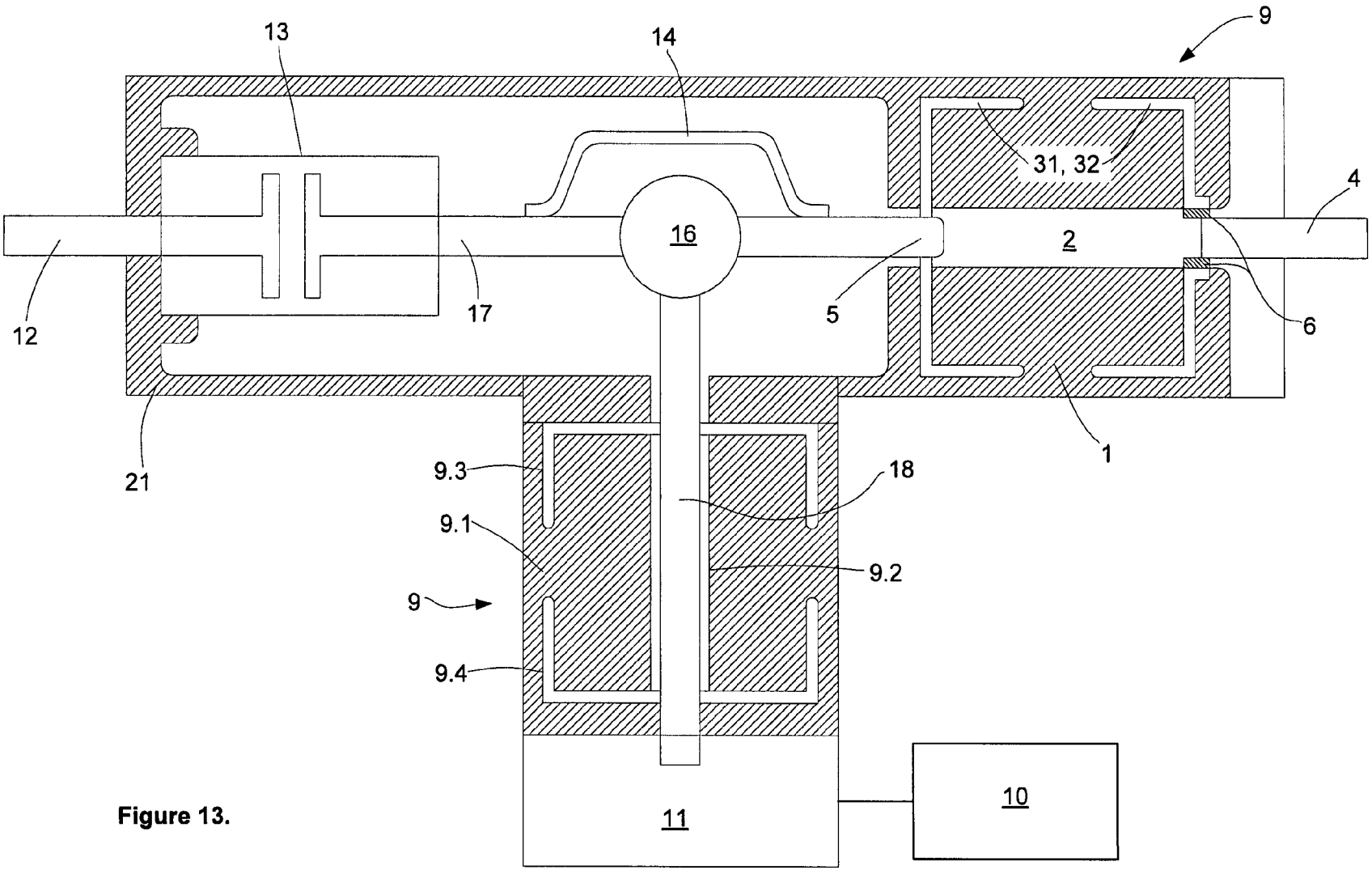
FIG. 13 shows an example of a switch disconnector in accordance with the current arrangement.

FIG. 13 shows an example of a further arrangement wherein the isolator 9 is applied to a specific arrangement of an electrical switch. The electrical switch includes an insulated housing 21, an interrupter 13 inside the housing 21 for interrupting an electrical current, and the isolator 9, as described above. The switch also generally includes a mechanism 16 configured for actuating the interrupter 13 and the isolator 9.

The switch includes an insulated housing 21 and the isolator 9 is moulded into this insulated housing, as shown. In this implementation the isolator 9 is connected in series with a vacuum interrupter 13. The vacuum interrupter 13 has a moving contact 17 and a fixed contact 12. The isolator 9 has fixed contact 4 and a moving contact 5. The moving contact of the vacuum interrupter 17 is electrically connected to the moving contact of the current arrangement 5 by a flexible conductor 14. Both the moving conductors 5 and 17 are mechanically driven by the mechanism 16. This mechanism is so designed to drive both the vacuum interrupter moving contact 17 and the current arrangement moving contact 5 at the required velocities, the required timing, and the required displacements to suit the switch ratings.

An insulating pushrod 18 passes through a second isolator assembly 9. The purpose of this second isolator 9 is to provide an area of low electrical stress that allows a shorter insulating pushrod 18 to be used than would otherwise be required. This insulating pushrod 18 is driven mechanically from a mechanism 11. The mechanism 11 may be manually operated, or electrically operated by any one of many suitable operation mechanisms that persons skilled in the art would be familiar with. A controller (10) may be employed to control the mechanism 11 either manually, remotely or automatically by any one of many means that persons skilled in the art would be familiar with.

In one particular example, the second isolator 9 includes a chamber 9.1 having a passage 9.2 extending between the first and second regions. The passage can be provided in a dielectric material or similar as previously described, and typically has a pushrod or other member extending therethrough. At least two concave electrical field control screens 9.3, 9.4 are provided about the passage such that the screens lie transverse to the chamber and an open-end of each concave screen is directed towards the other, said screens being configured to distribute an electrical field in the chamber in order to provide a third region of low electrical stress within the passage so that the member extends through the third region.

It will be appreciated that an isolator of this form can be used to electrically isolate any two regions, and in particular can be used to isolate a region that is at a significantly higher electrical potential than another region, such as the inside of electrical switchgear. Despite this, the isolator allows an insulting member to extend between the regions, for example to allow the member to pass into switchgear housing.

This is particularly useful for allowing first and second regions, such as the inside and outside of high voltage switchgear, to be electrically isolated. In particular, this allows a member to pass into a region with a high electrical potential, whilst still maintaining required levels of insulation. Thus, the isolating chamber alters the electrical fields in such a way as to limit the maximum stress on the air in the chamber (as described earlier) which permits any insulating member that needs to enter into the high voltage region of the switchgear to be significantly shorter than if the electrical stress was not controlled by the isolating chamber leading to a more compact structure than would otherwise be possible. Examples of such members might include, but are not limited to mechanical operating shafts, optical fibres or fluid pipes circulating coolant.

Figure 14:
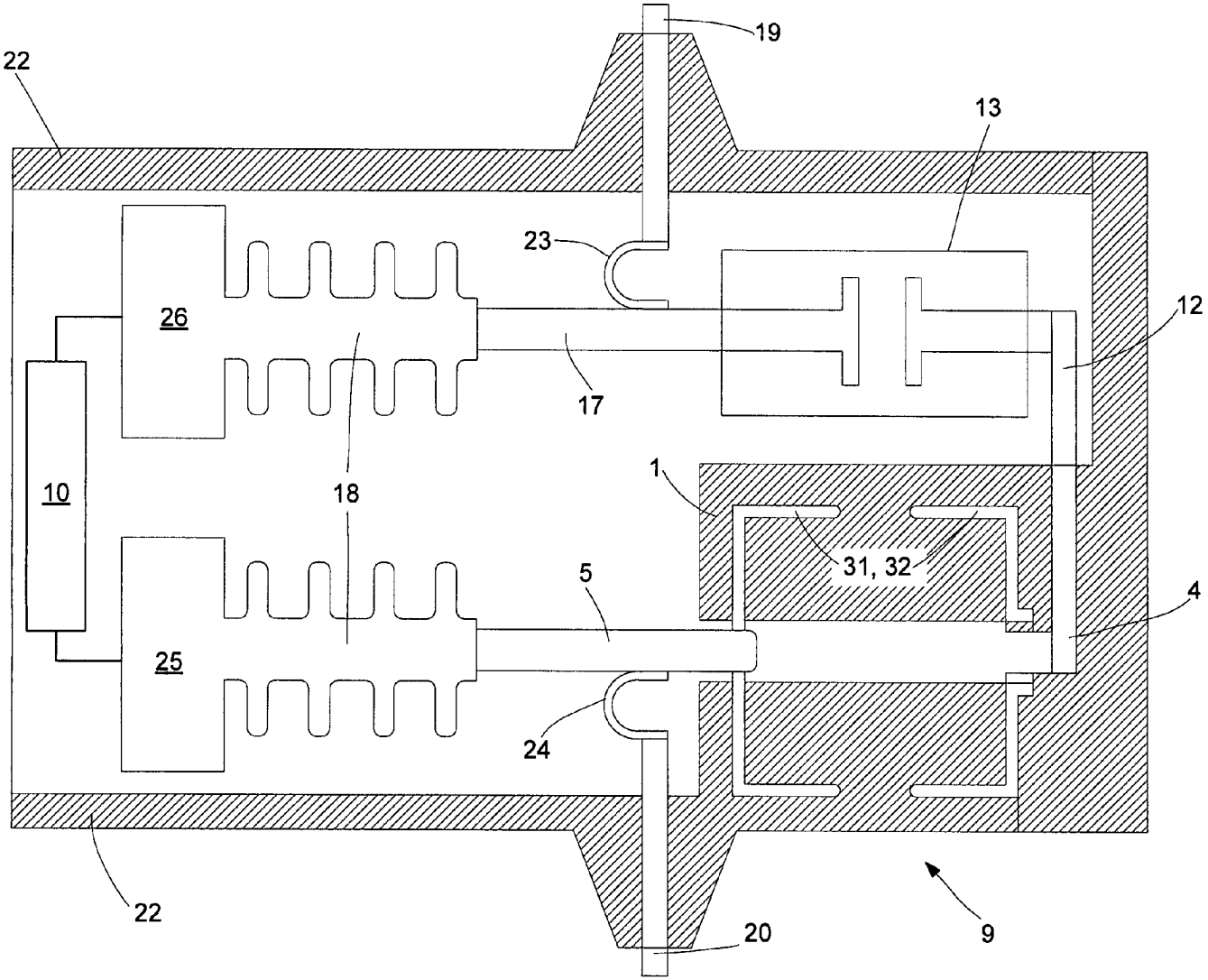
FIG. 14 shows a further example of a switch disconnector in accordance with the current arrangement.

FIG. 14 shows a further example wherein the isolator 9 is used as part of an electrical switch. The switch assembly is enclosed in an insulated housing 22 and the isolator 9 is moulded into the insulated housing 22. In this implementation the isolator 9 is connected in series with a vacuum interrupter 13. The vacuum interrupter 13 has a moving contact 17 and a fixed contact 12. The isolator 9 has fixed contact 4 and a moving contact 5. The moving contact of the vacuum interrupter 17 is electrically connected to the terminal of the switch assembly 19 by a flexible conductor 23. The moving contact of current arrangement 5 is electrically connected to the terminal of the switch assembly 20 by a flexible conductor 24. The moving conductors 5 and 17 are independently mechanically driven by the mechanism 25 and 26 respectively. These mechanisms are so designed to drive both the vacuum interrupter moving contact 17 and the isolator moving contact 5 at the required velocities, the required timing, and the required displacements to suit the switch ratings.

These insulating pushrods 18 are independently driven mechanically from a mechanism 25 and 26. These mechanisms may be manually operated, or electrically operated by any one of many suitable operation mechanisms that persons skilled in the art would be familiar with. A controller 10 may be employed to control these mechanisms either manually, remotely or automatically by any one of many means that persons skilled in the art would be familiar with.

Many modifications or variations will be apparent to those skilled in the art without departing from the scope of the present invention. All such variations and modifications should be considered to fall within the spirit and scope of the invention broadly appearing and described in more detail herein.

It is to be appreciated that reference to "one example" or "an example" of the invention is not made in an exclusive sense. Accordingly, one example may exemplify certain aspects of the invention, whilst other aspects are exemplified in a different example. These examples are intended to assist the skilled person in performing the invention and are not intended to limit the overall scope of the invention in any way unless the context clearly indicates otherwise.

Features that are common to the art are not explained in any detail as they are deemed to be easily understood by the skilled person. Similarly, throughout this specification, the term "comprising" and its grammatical equivalents shall be taken to have an inclusive meaning, unless the context of use clearly indicates otherwise.

The claims defining the invention are as follows:

1. An electrical isolator, comprising:

a) a body having an aperture formed therethrough defining first and second ends of said aperture;

b) a first electrical contact disposed at said first end of said aperture;

c) a second electrical contact movably disposed at said second end of said aperture, said second electrical contact configured to be operatively movable through said aperture to electrically connect to, or disconnect from, said first electrical contact; and d) at least two concave electrical field control screens each fixed to said body at a respective end of and about said aperture, said at least two concave screens lying transverse to said aperture, said at least two concave screens each having an open end, and said open ends of said at least two concave screens being directed towards each other.

2. The electrical isolator according to claim 1, wherein said body is manufactured from a solid dielectric insulating material.

3. The electrical isolator according to claim 1, wherein said aperture is tubular.

4. The electrical isolator according to claim 1, which further comprises a sliding contact configured to connect said first electrical contact to said second electrical contact in said aperture.

5. The electrical isolator according to claim 1, which further comprises a mechanism configured to actuate said second electrical contact through said aperture into, or out of, contact with said first electrical contact.

6. The electrical isolator according to claim 1, wherein said body includes an external conductive screen.

7. The electrical isolator according to claim 6, wherein said external conductive screen includes a conductive paint or a sprayed metal coating.

8. The electrical isolator according to claim 6, wherein said external conductive screen is grounded during use.

9. The electrical isolator according to claim 1, wherein said at least two concave screens are configured to modify an electrical field in said aperture to maintain a desired electrical stress profile between said first and second electrical contacts.

10. An electrical isolator, comprising:

a) a body having an aperture formed therethrough defining first and second ends of said aperture;

b) a first electrical contact disposed at said first end of said aperture;

c) a second electrical contact movably disposed at said second end of said aperture, said second electrical contact configured to be operatively movable through said aperture to electrically connect to, or disconnect from, said first electrical contact; and d) at least two electrical field control screens each extending outwardly from a respective one of said ends of said aperture.

11. The electrical isolator according to claim 10, wherein said body is manufactured from a solid dielectric insulating material.

12. The electrical isolator according to claim 10, wherein said aperture is tubular.

13. The electrical isolator according to claim 10, which further comprises a sliding contact configured to connect said first electrical contact to said second electrical contact in said aperture.

14. The electrical isolator according to claim 10, which further comprises a mechanism configured to actuate said second electrical contact through said aperture into, or out of, contact with said first electrical contact.

15. The electrical isolator according to claim 10, wherein said body includes an external conductive screen.

16. The electrical isolator according to claim 15, wherein said external conductive screen includes a conductive paint or a sprayed metal coating.

17. The electrical isolator according to claim 15, wherein said external conductive screen is grounded during use.

18. The electrical isolator according to claim 10, wherein said at least two electrical field control screens are configured to modify an electrical field in said aperture to maintain a desired electrical stress profile between said first and second electrical contacts.

19. An electrical switch, comprising:

a) a housing;

b) an interrupter disposed inside said housing for interrupting an electrical current; and c) an isolator disposed inside said housing and disposed in electrical communication with said interrupter, said isolator including:

i) a body having an aperture formed therethrough defining first and second ends of said aperture;

ii) a first electrical contact disposed at said first end of said aperture;

iii) a second electrical contact movably disposed at said second end of said aperture, said second electrical contact configured to be operatively movable through said aperture to electrically connect to, or disconnect from, said first electrical contact;

iv) at least two concave electrical field control screens each fixed to said body at a respective end of and about said aperture, said concave screens lying transverse to said aperture, said concave screens each having an open end, and said open ends of said concave screens being directed towards each other; and v) a mechanism configured to actuate said interrupter and said isolator (9).

20. The electrical switch according to claim 19, wherein said interrupter includes a vacuum interrupter.

21. The electrical switch according to claim 19, wherein said mechanism includes an insulating pushrod entering said housing through a passage in a portion of said housing having said at least two concave screens fixed to said portion at respective ends of, and about, said passage, said at least two concave screens lying transverse to said passage, said open ends of said at least two concave screens being directed towards each other, and said at least two concave screens being configured to distribute an electrical field in said passage to provide an area of low electrical stress.

22. The electrical switch according to claim 19, wherein said at least two concave screens are configured to modify an electrical field in said aperture to maintain a desired electrical stress profile between said first and second electrical contacts.

23. An electrical switch, comprising an interrupter and an isolator according to claim 1.

24. An electrical isolating chamber for electrically isolating first and second regions, the isolating chamber comprising:

a) a passage extending between the first and second regions;

b) an insulating pushrod extending through said passage; and c) at least two concave electrical field control screens disposed about said passage, said at least two concave screens lying transverse to the chamber, said at least two concave screens each having an open end, said open ends of said at least two concave screens being directed towards each other, said at least two concave screens being configured to distribute an electrical field in the chamber to provide a third region of low electrical stress, and said insulating pushrod extending through said third region.

25. The electrical isolating chamber according to claim 24, wherein at least one of the first and second regions is provided inside a housing for electrical equipment.

26. The electrical isolating chamber according to claim 24, wherein said at least two concave screens are configured to modify the electrical field in the chamber to maintain a desired electrical stress profile along said insulating pushrod.

27. The electrical isolating chamber according to claim 24, wherein said insulating pushrod includes at least one of:

a) a mechanical actuator;

b) optical fibers; or c) fluid pipes.

* * * * *

UNITED STATES PATENT AND TRADEMARK OFFICE

CERTIFICATE OF CORRECTION

PATENT NO. : 9,076,602 B2
APPLICATION NO. : 13/808642
DATED : July 7, 2015
INVENTOR(S) : Brett Watson It is certified that error appears in the above-identified patent and that said Letters Patent is hereby corrected as shown below:

ON THE TITLE PAGE

(73) Assignee should read: Siemens Ltd., Bayswater (AU)

Signed and Sealed this
Twenty-ninth Day of March, 2016

Michelle K. Lee

Michelle K. Lee
*Director of the United States Patent and Trademark Office*